United States Patent [19]

Byrne

[11] Patent Number: 4,483,420

[45] Date of Patent: Nov. 20, 1984

[54] ELEVATOR DOOR INTERLOCKING APPARATUS

[76] Inventor: Francis J. Byrne, 43 Francine Ave., Massapequa, N.Y. 11758

[21] Appl. No.: 394,164

[22] Filed: Jul. 1, 1982

[51] Int. Cl.[3] ..... B66B 1/00

[52] U.S. Cl. ..... 187/31; 187/61

[58] Field of Search ..... 187/30, 31, 61, 49, 187/50, 57, 59; 49/279, 280, 381; 70/465; 292/300

[56] References Cited

U.S. PATENT DOCUMENTS

| | | | |
|---|---|---|---|
| 929,988 | 8/1909 | Shand | 187/61 |
| 1,495,808 | 5/1924 | Schakel et al. | 187/31 |
| 1,835,544 | 12/1931 | Werner | 187/31 |
| 1,979,022 | 10/1934 | Borden et al. | 187/31 |
| 2,008,665 | 7/1935 | Eisenbart | 187/61 |
| 2,280,805 | 4/1942 | Dodd | 187/31 |
| 2,307,542 | 3/1942 | Prince | 187/61 |
| 2,521,965 | 9/1950 | Carta | 187/31 |
| 2,611,840 | 9/1952 | Rogers | 200/61.65 |
| 2,918,988 | 12/1959 | Green | 187/31 |
| 3,625,312 | 12/1971 | Hutner | 187/57 |

*Primary Examiner*—Joseph J. Rolla
*Assistant Examiner*—Kenneth Noland
*Attorney, Agent, or Firm*—Kenyon & Kenyon

[57] ABSTRACT

An elevator hatchway door interlocking mechanism. The interlocking mechanism includes a first latch member movably mounted in a housing in the elevator hatchway which engages with a second latch member mounted on the hatchway door. A first contact assembly mounted in the housing engages with a second contact assembly mounted on the door when the door is closed. A third contact assembly movably mounted in the housing and operatively connected to the first latch member engages with a fourth contact assembly mounted on the second latch member. The elevator car is prevented from moving until the door is closed, the first and second latch members have engaged each other, and both sets of electrical contacts are made. Additionally, a manually operable releasing tool is provided for emergency or service use.

14 Claims, 8 Drawing Figures

Fig. 3.
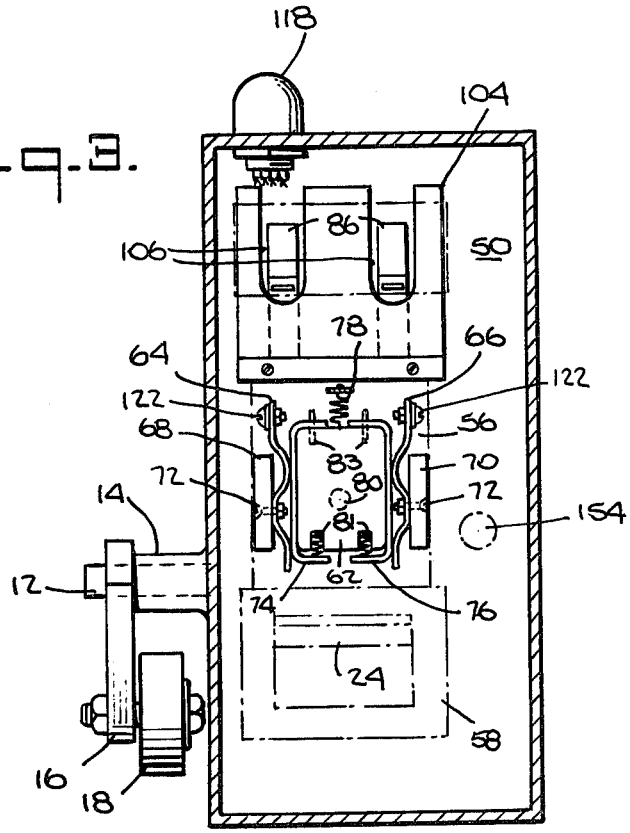
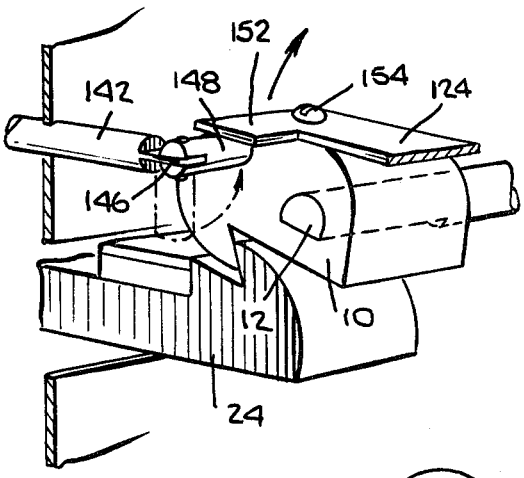
Fig. 7.
Fig. 5.
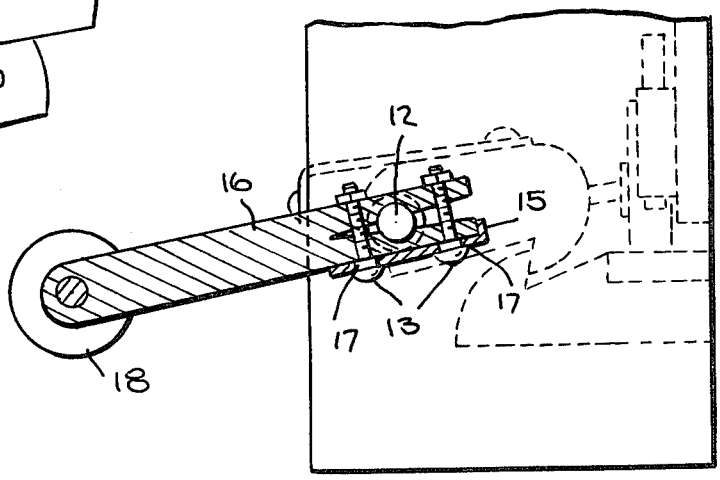

ELEVATOR DOOR INTERLOCKING APPARATUS

BACKGROUND OF THE INVENTION

1. Field of the Invention

The present invention relates to elevator hatchway door interlocking mechanisms, and particularly to an improved elevator hatchway door interlocking mechanism for use in conjunction with small elevator installations having hinged rather than sliding hatchway doors and which makes accidental or deliberate circumvention of the interlocking mechanism remote.

2. Description of the Prior Art

Elevator hatchway door interlocking mechanisms are known in the art. For example, U.S. Pat. No. 1,835,544 describes an elevator door having a dual latching mechanism with a plurality of electrical contacts which must complete an electrical circuit before the elevator car can move from the hatchway landing. U.S. Pat. No. 2,307,542 discloses another interlocking mechanism which uses a permanent magnet to pull a latching member into a recess in the elevator hatchway door. U.S. Pat. Nos. 2,611,840, 1,979,022, 2,280,805 and 2,918,988 disclose other hatchway door interlocking mechanisms. All of these interlocking mechanisms have various disadvantages. Some are more complex than they need to be to accomplish their function, i.e., the prevention of elevator car movement when it is not safe for such movement. For example, the mechanisms described in U.S. Pat. Nos. 2,307,542, 1,979,022 and 2,611,840 suffer from this disadvantage. Another drawback to many of the prior art interlocks is the rather simple way in which they can be deliberately circumvented. For example, U.S. Pat. No. 1,835,544 shows electrical contacts directly behind openings in the interlock housing for receiving corresponding contacts and latches which are not protected against deliberate short circuiting, as for example, by the insertion of a metal object into the opening.

SUMMARY OF THE INVENTION

It is an object of the present invention to provide an improved elevator hatchway door interlocking mechanism which eliminates the defects of prior art interlocks and provides a simple and direct interlocking mechanism which uses few moving parts.

It is also an object of the present invention to provide an elevator hatchway door interlocking mechanism which will lock the hatchway door when the elevator car is not present at the hatchway landing, and which unlocks the door when an elevator car is present at the landing.

It is also an object of the present invention to provide an elevator hatchway door interlocking mechanism in which access to the electrical contacts disposed within the interlock housing is restricted so that the contacts cannot be easily short circuited when the elevator hatchway door is open and an elevator car present at the landing, thus preventing movement of the elevator car when the door is ajar.

It is a further object of the present invention to provide an elevator hatchway door interlocking mechanism which is manually releasable for service or emergency reasons only by authorized persons, as for example, in the event the door fails to open, or in order to service the elevator hatchway when an elevator car is not present at the hatchway landing.

These and other objects of the present invention are achieved in an interlocking mechanism having first latch member means movably mounted in a housing adapted for mounting in the hatchway which engages with second latch member means adapted for mounting to the elevator hatchway door through a first aperture in the housing when the door is closed and an elevator car not present at the hatchway landing. First electrical contact means are disposed in the housing which receive second electrical contact means adapted for mounting to the hatchway door through a second aperture in the housing when the door is closed. The improvement comprises third electrical contact means movably disposed within the housing and fourth electrical contact means disposed on the second latch member means for engaging the third electrical contact means. The third electrical contact means are operatively connected to the first latch member means so that the third and fourth electrical contact means engage and are electrically connected when the first latch member means engages the second latch member means. The elevator car is then prevented from moving until the elevator hatchway door is closed, the first and second latch member means have engaged each other, and the first and second electrical contact means and third and fourth electrical contact means have respectively engaged each other.

These and other novel features and advantages of the present invention will be described in greater detail in the following detailed description.

BRIEF DESCRIPTION OF THE DRAWINGS

FIG. 3 is a front view of the interlocking mechanism shown in FIG. 1;

FIG. 5 is a side view of an actuating lever coupled to one of the latch members of the mechanism which is operated by an elevator car and disengages the interlocking mechanism;

FIG. 7 is a perspective view of the engaged latch members illustrating how the releasing tool is used.

DETAILED DESCRIPTION

Figure 1:
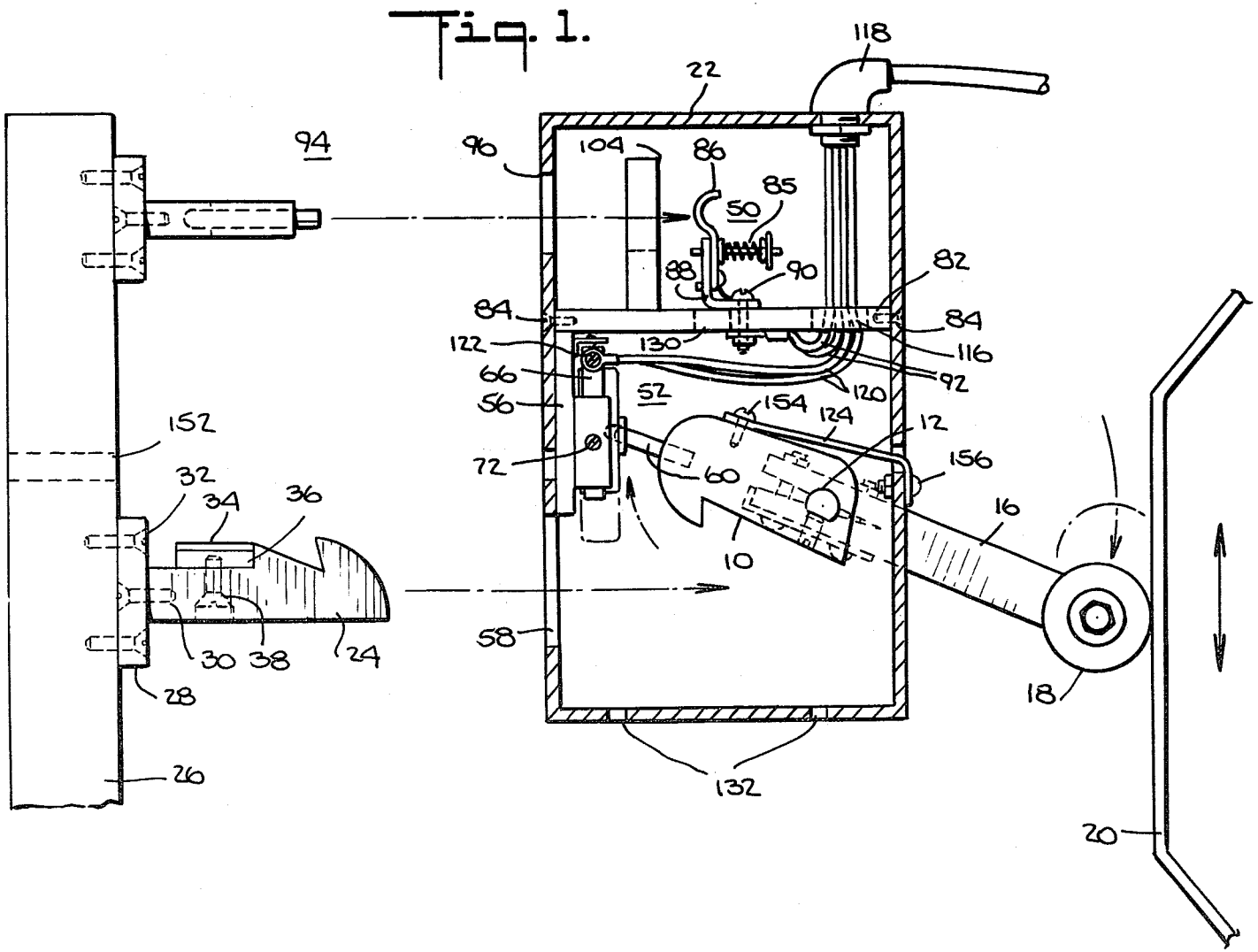
FIG. 1 is a cross-sectional side view of one embodiment of an improved elevator hatchway door interlocking mechanism constructed according to the present invention showing the mechanism in its disengaged position, i.e., when the elevator door is open.
Figure 2:
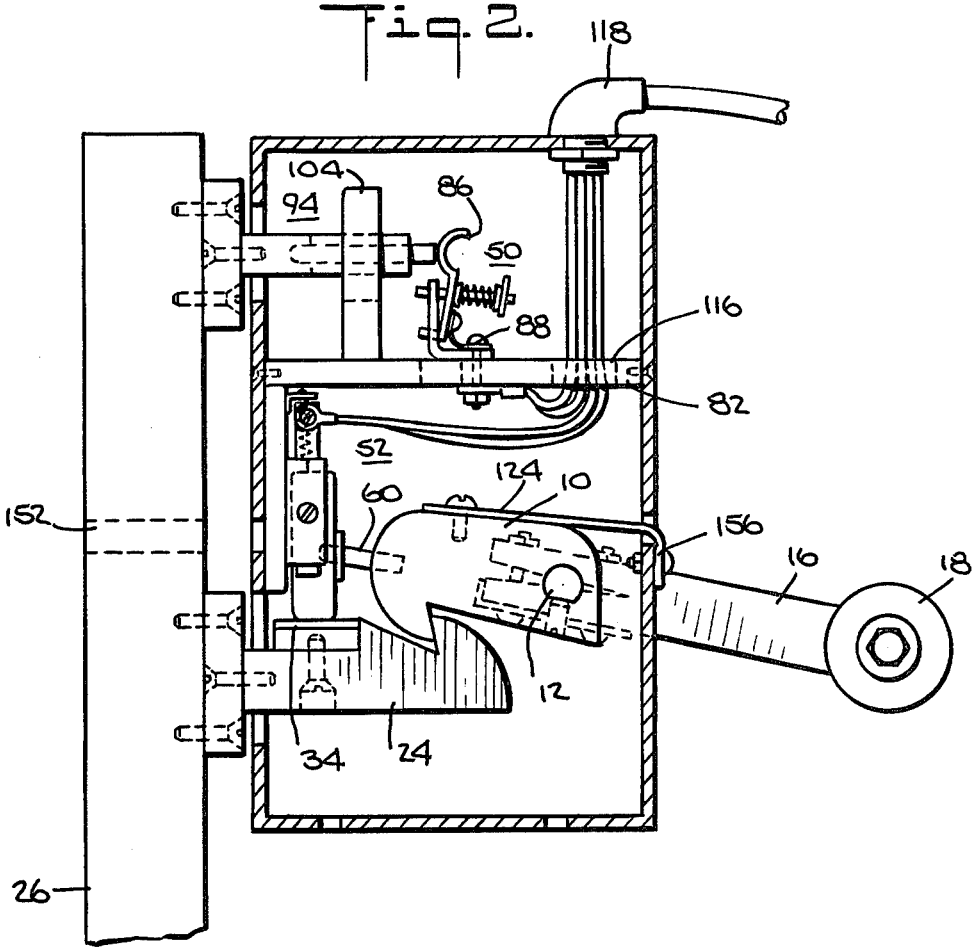
FIG. 2 is a cross-sectional side view of the interlocking mechanism showing the mechanism in its engaged position with the door closed and locked and with all electrical contacts made, so that the elevator car can be safely moved.

Referring now to the drawings, the interlocking mechanism is shown in its disengaged position in FIG. 1 and in its engaged position in FIG. 2. First latch member 10 is pivotally mounted on shaft 12 which extends through one side of the housing 22 through bushing 14 as best shown in FIG. 3. A lever 16 is mounted to the shaft 12 where the shaft extends through the housing. An engageable member, such as a cam or roller 18 is mounted to the other end of the lever 16. An actuator, such as a retiring cam assembly 20 operated by a mechanism on the elevator car applies pressure to the roller 18 to retract latch member 10.

As shown in FIG. 5, lever 16 has a forked end for tightly gripping shaft 12 when carriage bolts 13 are tightened. An L-shaped member 15 having two square holes 17 prevents the carriage bolts from turning when tightening. This arrangement is particularly convenient in the tight quarters of elevator hatchways, and allows tightening of the lever 16 to the shaft 12 with one wrench. Latch member 10 engages with corresponding second latch member 24 mounted on the elevator hatchway door 26. FIG. 2 illustrates latch member 10 engaging latch member 24 when the hatchway door is closed.

Latch member 24 is mounted to a spacer block 28 via fasteners such as screws 30. Spacer block 28 is mounted to the door 26 with additional fasteners such as screws 32. Latch member 24 carries an electrical contact 34 insulated from the latch member by insulator 36. A fastener 38 mounts the insulator to latch member 24. The electrical contact 34 is suitably bonded to insulator 36.

Housing 22 contains two electrical contact assemblies indicated by reference numbers 50 and 52, which respectively engage corresponding contact assemblies 94 and 34 mounted to door 26. First contact assembly 50 is mounted to an insulating block 82 suitably fastened in the housing such as by screws 84, and comprises a pair of contacts 86 spring mounted with springs 85 to L-shaped brackets 88, which are in turn fastened to the insulating block 82 by screws which form terminals 90 for a pair of wires 92. A hole in insulating block 82 allows wires for both contact assemblies 50 and 52 to pass to conduit elbow 118 and out of the housing to the elevator control circuitry. A second electrical contact assembly, U-shaped contact 94, is fastened to the door 26 above latch member 24, and is received by housing 22 through opening 96. Contact assembly 94 comprises a U-shaped contact 98 embedded in a suitable insulating material 100. Insulating material 100 is mounted to the door by screws 102. Contact assembly 50 is concealed behind insulating block 104, which has two slotted apertures 106 directly in front of each contact 86, for allowing contact assembly 94 to pass therethrough when the door is closed. Additionally, insulating block 82 on which contact assembly 50 is mounted has a hole 130 located between contacts 86, thus allowing water which might become trapped atop insulating block 82 to drip through to the bottom of the housing 22 and out drain holes 132.

Third contact assembly 52 is mounted in the housing and can best be seen in FIG. 3. As shown in the drawings, contact assembly 52 is mounted on insulator 56 above opening 58 and is thus concealed in housing 22. Two fixed contacts 64 and 66 are mounted to insulating blocks 68 and 70 with suitable fasteners 72. A pair of wires 120 are connected to contacts 64 and 66 by suitable fasteners 122. Two sliding contacts 74 and 76 insulated from each other are fastened to insulating block 62. These contacts may be coupled to insulating block 62 at the lower end thereof with small springs 81 to provide a cushioning effect. The contacts are suitably fastened with screws or pins 83 at the upper end of insulating block 62. A spring 78 normally urges insulating block 62 upwards. Sliding contacts 74 and 76 are always in electrical contact with fixed contacts 64 and 66, respectively.

Insulating block 62 contains a recess 80. A rigid link 60 fastened to latch member 10 has its free end resting in recess 80 on the insulating block 62. When the hatchway door is closed, contact assembly 94 bridges contacts 86 of contact assembly 50. Retiring cam 20 then relieves pressure on roller 18. Flat spring 124 forces latch member 10 into engagement with latch member 24. Link 60, fastened to latch member 10, moves insulating block 62 containing sliding contacts 74 and 76 into engagement with a fourth contact assembly comprising contact 34 on latch member 24 mounted to door 26, thus completing the second electric circuit, and signalling to the elevator control system that the elevator car may be safely moved. The dual contact assemblies 50 and 52 and concealed nature of these contact assemblies makes it remote that the interlocking mechanism could be either deliberately or accidentally circumvented. Additionally, the location of contact 34 on latch member 24 doubly insures that the door is closed before the elevator car can be moved.

Figure 6:
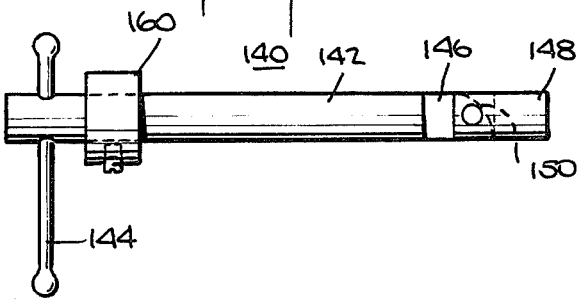
FIG. 6 is a side view of one embodiment of a releasing tool for manually unlocking the hatchway door in emergency or service situations.
Figure 4:
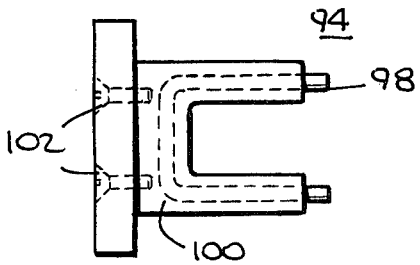
FIG. 4 is a top view of the upper electrical contact carried by the hatchway door.
Figure 8:
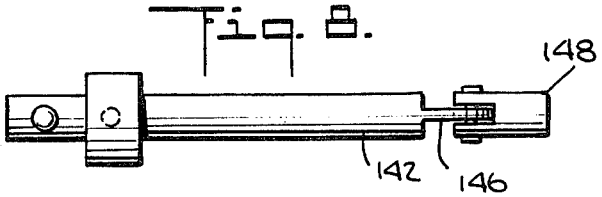
FIG. 8 is a top view of the releasing tool of FIG. 6.

A manually operable releasing mechanism for use in the event of an emergency or for service is also provided. FIGS. 6 and 8 illustrate the releasing key 140 used to manually unlock the interlock of the invention. Key 140 comprises a shaft 142 with T handle 144 slideably mounted at the end thereof. At the opposite end, shaft 142 has a flat extension 146 machined thereto. Grooved member 148 is pinned to extension 146 and pivots at a right angle to shaft 142 in one direction only, by virtue of the curved end 150 of extension 146.

The releasing key 140 provides the elevator mechanic with a simple means for opening the hatchway door when an elevator car is not present at that particular landing, for example, in the event of an emergency or to service the elevator hatchway. Additionally, the key allows the mechanic to open the hatchway door in the event the actuating mechanism 20 or interlocking mechanism fails to unlock the door when the elevator car is present at the landing. In order to manually unlock door 26, the key 140 is inserted, while member 148 is colinear with shaft 142, through keyhole 152 in door 26 and keyhole 154 in housing 22. Collar 160 set screwed to shaft 142 allows insertion of the key only to the extent necessary to unlock the door. Key 140 is then twisted through 180 degrees so that member 148 falls by gravity to form a right angle with respect to shaft 142 as shown by the phantom lines in FIG. 7. Key 140 is then turned an additional 90 degrees so that member 148 is at the position indicated by the solid lines. At this point, member 148 contacts a projection 152 on flat spring 124. Spring 124 is fastened to latch member 10 with a screw or other suitable fastener 154. The opposite end of spring 124 is fastened to housing 22 by a fastener at 156. To release latch member 10 from engagement with latch member 24, key 140 is turned through an additional arc so that member 148 forces spring 124 upward and thus causes latch member 10 to clear latch member 24, thereby allowing the door to be opened. The use of key 140 with right angle swivel member 148 makes it very remote that unauthorized persons could successfully open the door using, for example, a screwdriver or wire rod.

Alternatively, the projection 152 shown in the illustrated embodiment as an integral part of spring 124 could be mounted directly to latch member 24.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In an apparatus for locking a hinged elevator hatchway door in a closed position in an elevator doorway when an elevator car is not present at said doorway, said apparatus including housing means adapted for mounting in said elevator doorway, first latch member means movably mounted in said housing means, first electrical contact means disposed in said housing means, second electrical contact means adapted for mounting on said elevator hatchway door for engaging said first electrical contact means when said door is disposed in said closed position, second latch member means adapted for mounting on said elevator hatchway door and adapted to engage said first latch member means when said elevator hatchway door is disposed in said closed position and said elevator car is not present at said doorway, said housing means further including first aperture means for receiving said second latch member means and second aperture means for receiving said second electrical contact means when said elevator hatchway door is disposed in said closed position, the improvement comprising, third electrical contact means disposed within said housing means, and fourth electrical contact means disposed on said second latch member means for engaging said third electrical contact means, said third electrical contact means being operatively connected to said first latch member means and being slidably mounted relative to said first latch member means and in a direction substantially transverse to a longitudinal dimension of said first latch member means so as to move in a vertical direction toward said fourth electrical contact means when said elevator hatchway door is disposed in said closed position, said third electrical contact means being hidden in said housing means between said first and second aperture means so that when said door is disposed in said closed position and said first and second latch member means engage, said third electrical contact means moves toward said second latch member means and is electrically connected to said fourth electrical contact means, whereby said elevator car is prevented from moving until said elevator hatchway door is closed, said first latch member means has engaged said second latch member means, and said first and second electrical contact means and said third and fourth electrical contact means are engaged.

2. The improvement recited in claim 1, further comprising insulating means disposed between said fourth electrical contact means and said second latch member means.

3. The improvement recited in claim 1, further comprising insulating means disposed between said second aperture means and said first electrical contact means for restricting access to said first electrical contact means in said housing means.

4. The improvement recited in claim 3 wherein said insulating means comprises an insulating member having aperture means therein for receiving said second electrical contact means.

5. The improvement recited in claim 1, further comprising shaft means extending through at least one side of said housing means, said first latch member means being pivotally mounted on said shaft means, and actuating means comprising lever means mounted at one end thereof to said shaft means and including means engageable by said elevator car mounted to the other end of said lever means for engaging and disengaging said first and second latch member means.

6. The improvement recited in claim 5 wherein said lever means has an aperture at the end mounted to said shaft means for receiving said shaft means, said end further being bifurcated through said aperture in the longitudinal direction of said lever means, and further comprising first and second screw means disposed in first and second bores, respectively, through said lever means on either side of said aperture for clamping said lever means to said shaft means, said first and second screw means each having head means, and connecting plate means, said first and second screw means disposed in first and second holes, respectively, in said plate means disposed in alignment with said first and second bores, respectively, said head means abutting said plate means, said plate means holding said first and second screw means in position when said first and second screw means are tightened.

7. The improvement recited in claim 1, further comprising means for biasing said first latch member means into engagement with said second latch member means.

8. The improvement recited in claim 7, further comprising manually-operable releasing means for disengaging said first latch member means for engagement with said second latch member means and thereby unlocking said elevator hatchway door.

9. The improvement recited in claim 8 wherein said first latch member means includes projecting member means disposed on the surface thereof, said elevator hatchway door includes first key-accessible aperture means, said housing means includes second key-accessible aperture means adjacent said first aperture means and disposed in alignment with said first key-accessible aperture means, and said manually-operable releasing means comprises a key member insertable through said first and second key-accessible aperture means having a pivotable right-angle extension member at one end thereof which when twisted in said key-accessible aperture means, engages said projecting member means, thereby releasing said first latch member means from engagement with said second latch member means and unlocking said door.

10. The improvement recited in claim 9 wherein said biasing means comprises planar spring means coupled at one end to said housing means and adjacent the other end thereof to said first latch member means.

11. The improvement recited in claim 10 wherein said projecting member means extends from said planar spring means.

12. In an apparatus for locking a hinged elevator hatchway door in a closed position in an elevator doorway when an elevator car is not present at said doorway, said apparatus including housing means adapted for mounting in said elevator doorway, first latch member means movably mounted in said housing means, first electrical contact means disposed in said housing means, second electrical contact means adapted for mounting on said elevator hatchway door for engaging said first electrical contact means when said door is disposed in said closed position, second latch member means adapted for mounting on said elevator hatchway door and adapted to engage said first latch member means when said elevator hatchway door is disposed in said closed position and said elevator car is not present at said doorway, said housing means further including first aperture means for receiving said second latch member means and second aperture means for receiving said second electrical contact means when said elevator hatchway door is disposed in said closed position, the improvement comprising, third electrical contact means disposed within said housing means, and fourth electrical contact means disposed on said second latch member means for engaging said third electrical contact means, said third electrical contact means being operatively connected to said first latch member means so that said third and fourth electrical contact means engage and are electrically connected when said first latch member means engages said second latch member means, whereby said elevator car is prevented from moving until said elevator hatchway door is closed, said first latch member means has engaged said second latch member means, and said first and second electrical contact means and said third and fourth electrical contact means are engaged, said first latch member means further including projecting member means disposed on the surface thereof, and means for biasing said first latch member means into engagement with said second latch member means, said elevator hatchway door including first key-accessible aperture means, said housing means including second key-accessible aperture means adjacent said first aperture means and disposed in alignment with said first key-accessible aperture means, and further including manually-operable releasing means comprising a key member insertable through said first and second key-accessible aperture means having a pivotable right-angle extension member at one end thereof which when twisted in said key-accessible aperture means, engages said projecting member means, thereby releasing said first latch member means from engagement with said second latch member means and unlocking said door.

13. The improvement recited in claim 12 wherein said biasing means comprises planar spring means coupled at one end to said housing means and adjacent the other end thereof to said first latch member means.

14. The improvement recited in claim 13 wherein said projecting member means extends from said planar spring means.

* * * * *